US010961784B2

(12) United States Patent
Chen et al.

(10) Patent No.: US 10,961,784 B2
(45) Date of Patent: Mar. 30, 2021

(54) ROTATING CUTTER SINGLE CONE BIT

(71) Applicants: SOUTHWEST PETROLEUM UNIVERSITY, Sichuan (CN); CHENGDU WEIYI PETROLEUM TECHNOLOGY CO., LTD., Sichuan (CN)

(72) Inventors: Lian Chen, Sichuan (CN); Yingxin Yang, Sichuan (CN); Zongliang Xie, Sichuan (CN); Haitao Ren, Sichuan (CN); Liyuan Yang, Sichuan (CN)

(73) Assignees: SOUTHWEST PETROLEUM UNIVERSITY, Sichuan (CN); CHENGDU WEIYI PETROLEUM TECHNOLOGY CO., LTD., Sichuan (CN)

( * ) Notice: Subject to any disclaimer, the term of this patent is extended or adjusted under 35 U.S.C. 154(b) by 0 days.

(21) Appl. No.: 16/463,989

(22) PCT Filed: Dec. 29, 2017

(86) PCT No.: PCT/CN2017/119859
§ 371 (c)(1),
(2) Date: May 24, 2019

(87) PCT Pub. No.: WO2018/095441
PCT Pub. Date: May 31, 2018

(65) Prior Publication Data

US 2020/0217141 A1 Jul. 9, 2020

(30) Foreign Application Priority Data

Nov. 25, 2016 (CN) ..... 201611055703.X

(51) Int. Cl.
*E21B 10/16* (2006.01)
*E21B 10/50* (2006.01)

(52) U.S. Cl.
CPC ..... *E21B 10/16* (2013.01); *E21B 10/50* (2013.01)

(58) Field of Classification Search
CPC ..... E21B 10/50; E21B 10/16
See application file for complete search history.

(56) References Cited

U.S. PATENT DOCUMENTS 4,320,808 A 3/1982 Garrett
2005/0165592 A1* 7/2005 Huang ..... E21B 10/16 703/7

FOREIGN PATENT DOCUMENTS

CN 203729882 U 7/2014
CN 205445474 U 8/2016
(Continued)

*Primary Examiner* — David J Bagnell
*Assistant Examiner* — Dany E Akakpo
(74) *Attorney, Agent, or Firm* — Novick, Kim & Lee, PLLC; Allen Xue

(57) ABSTRACT

A rotating cutter single cone bit includes a bit body and a cone that is rotatably coupled to the bit body. Cutters are arranged on the cone. At least one cutter on the cone is a rotating cutter. The rotating cutter forms a rotational connection with the cone. The geometric center of the front cutting face of the rotating cutter or the front cutting face of the rotating cutter is offset from the rotating axis of the rotating cutter, and the geometric center of the rear cutting face or the rear cutting face of the rotating cutter is on the same side of the offset of the front cutting face. The front cutting face is closer to the rotating axis of the rotating cutter than the rear cutting face. The rotating cutter is rotatable about the rotating axis of the rotating cutter on the cone.

12 Claims, 9 Drawing Sheets

(56) References Cited

FOREIGN PATENT DOCUMENTS

| | | | |
|---|---|---|---|
| CN | 106368617 | A | 2/2017 |
| CN | 106382098 | A | 2/2017 |
| CN | 106401484 | A | 2/2017 |
| CN | 206174875 | U | 5/2017 |
| CN | 206190213 | U | 5/2017 |
| CN | 206190217 | U | 5/2017 |
| CN | 206205791 | U | 5/2017 |

* cited by examiner

ROTATING CUTTER SINGLE CONE BIT

TECHNICAL FIELD

The present disclosure relates to drilling equipment technologies for petroleum and natural gas, mining engineering, infrastructure construction, geological and hydrological projects. More particularly, it relates to a rotating cutter single cone bit.

DESCRIPTION OF THE RELATED ART

Drill bit is a rock-breaking tool in drilling engineering used to break rock and to form wellbores. Currently, drill bits used in drilling engineering are mainly cone bits and PDC (polycrystalline diamond compact) bits.

The cone on the cone bits is rotationally connected with the bit body through the bearing system. When the bit is working, the rotation of the bit body drives the cone to rotate around the axis of the bit, while the cone also rotates around its own axis. The teeth on the cone make complex compound movement under the combination of the above two movements. The cone bits are non-fixed cutter bit.

Single cone bit is one of the cone bits. It is one of the main rock-breaking tools used in drilling engineering, especially in slim hole drilling of deep and ultra-deep wells. The teeth on the cone of a single cone bit cut rock by scraping. The teeth scrape the rock in a mesh form at the bottom of the well. One part of the teeth on the single cone bit (front end of the cone) always contact with the bottom of the well to break rock, the other part of the teeth alternately contact with the bottom of the well to break rock, which divides the cone of the single cone bit into a constant contact area (front end of the cone, as shown 21 of FIG. 9) and an alternating contact area (as shown 22 of FIG. 9).

During the drilling process of a single cone bit, the cone rotates around the axis of the bit while rotating around its own axis. The scraping direction of the teeth on the cone is constantly changing with respect to the rock at the bottom of the well. During the process of rock scraping, the scraping direction of the teeth on the constant contact area of the cone changes from 0 to 360 degrees, the scraping direction of the teeth on the alternating contact area of the cone changes from 0 to 180 degrees. This makes it impossible to directly apply diamond cutter, such as polycrystalline diamond compact (PDC), which is extremely suitable for rock-breaking in a scraping form, on single cone bit. The reason is that polycrystalline diamond compact is composed of two parts: the substrate and the polycrystalline diamond layer. The main scraping effect on the rock is the polycrystalline diamond layer. PDC cutter has directionality when scraping, only the polycrystalline diamond layer is in front and the substrate is in the back. If the PDC cutter is directly subjected to reverse force during the working process, it will easily cause the polycrystalline diamond layer to crack, seriously reduce the working life of the PDC cutter, and even make the PDC cutter damage in a very short time.

Therefore, the cutting teeth on the existing single cone bit are generally cemented carbide teeth. The wear resistance of the cemented carbide tooth is far less than that of the diamond cutter such as PDC cutter. Insufficient wear resistance of cutting teeth is the fatal weakness of the single cone bit. The easy wear of cutting teeth seriously affects the service life of the single cone bit.

SUMMARY OF THE INVENTION

The purpose of the present disclosure is to provide a single cone bit with rotating cutter to solve the problem that diamond cutters (such as PDC cutters) cannot be used on existing cone bits. At the same time, even if the cutters (such as cemented carbide cutters) which are consistent with the existing technology are used in the rotating cutter single cone bit, the wear and wear passivation speed of the cutters are better.

The present disclosure is realized by the following technical scheme:

A rotating cutter single cone bit, which comprises a bit body; and a cone that is rotatably coupled to the bit body, cutters are arranged on the cone, and at least one cutter on the cone is a rotating cutter, the rotating cutter forms a rotational connection with the cone, the geometric center of the front cutting face of the rotating cutter or the front cutting face of the rotating cutter is offset from the rotating axis of the rotating cutter, and the geometric center of the rear cutting face of the rotating cutter or the rear cutting face of the rotating cutter is on the same side of the offset of the front cutting face, the front cutting face is closer to the rotating axis of the rotating cutter than the rear cutting face, the rotating cutter is rotatable about the rotating axis of the rotating cutter on the cone.

The front cutting surface mentioned in this invention refers to the surface along which the cutting chips flow out when the cutters are cutting the formation. The rear cutting face refers to the surface of the cutter opposite the bottom hole formation. The rear cutting face is generally the face that faces the depth of cut (feed direction). Generally speaking, the intersection of the front cutting face and the rear cutting face forms a cutting edge, which serves as the main cutting work.

Compared with the conventional cemented carbide tooth, the composite cutter formed by the composite of the base body and the wear-resistant layer has a front cutting surface which is a front end surface of the wear-resistant layer. The rear cutting face is the side of the wear-resistant layer and/or the substrate. The wear-resistant layer is more resistant to wear than the substrate. The wear-resistant layer of the polycrystalline diamond compact, the polycrystalline diamond composite cutter, or the composite cutter formed by the combination of the polycrystalline diamond and the impregnated diamond is polycrystalline diamond layer, and the substrate is cemented carbide or impregnated diamond. During the cutting process of the cutter, the substrate is at the rear of the wear-resistant layer, which pushes and supports the front end surface of the wear-resistant layer.

Therefore, this invention mainly aims to protect a single cone bit with rotating cutters. The bit comprises a bit body and a cone that is rotatably coupled to the bit body. Cutters are arranged on the cone, and at least one cutter on the cone is a rotating cutter. The rotating cutter forms a rotating connection with the cone. The rotating cutter has wear-resisting layer and substrate. With the geometric center of the front end face of the wear-resistant layer as the demarcation point, the entirety or most areas of the rotating cutter including the geometric center is offset with respect to the rotating axis of the rotating cutter. The front end face of the wear-resistant layer is closer to the rotating axis of the rotating cutter than the substrate. The rotating cutter can rotate on the cone around its rotating axis.

In addition, it is obvious that the rotating cutters can also use cutters such as cemented carbide cutters, cubic boron carbide or impregnated diamond cutters. At this time, the rotating cutters are free of the wear-resistant layer and the substrate.

The wear-resistant layer of the polycrystalline diamond compact, the polycrystalline diamond composite cutter, or the composite cutter formed by the combination of the polycrystalline diamond and the impregnated diamond is polycrystalline diamond layer, and the substrate is cemented carbide or impregnated diamond. At this time, the front end face of the polycrystalline diamond layer is the front cutting face. According to the shape of the front end face, the front cutting face can be a plane (e.g. the most common regular cylinder PDC cutter, the front face of the polycrystalline diamond layer is a circular plane), a curved surface (e.g. the front face of the diamond layer forming a cone, hemisphere or ridge/wedge on the substrate), or a variety of surfaces. Similarly, the rear cutting face can be cylindrical (e.g. regular cylinder PDC teeth with polycrystalline diamond layer on the side) or other cylindrical surface, or plane, depending on the shape of the diamond layer or the side of the substrate.

Polycrystalline diamond compact, also known as PDC, consists of a polycrystalline diamond layer and a substrate (as shown in FIG. 10). The PDC is sintered by using diamond micro-powder and cemented carbide substrate under ultrahigh pressure and high temperature conditions. The diamond micro-powder forms a polycrystalline diamond layer of the PDC, and the cemented carbide becomes the substrate of the PDC. PDC not only have the high hardness and high wear resistance of diamond, but also have the strength and impact toughness of cemented carbide. PDC is ideal materials for manufacture of cutting tools, drilling bits and other wear-resistant tools. PDC is suitable for working in a scraping manner. Because the hardness and wear resistance of the polycrystalline diamond layer of PDC is much higher than that of the substrate of cemented carbide material, the PDC cutter has self-sharpening property during scraping, that is, the wear rate of the polycrystalline diamond layer is obviously slower than that of the substrate, which keeps the cutting edge (hard and wear-resistant diamond layer) of the PDC cutter sharp all the time.

When the PDC cutter is scraped, the main scraping action is the polycrystalline diamond layer. The polycrystalline diamond layer of the PDC cutter is hard and brittle, the substrate is relatively soft but has good impact toughness. Therefore, the PDC cutter has a directionality during scraping work. When scraping, only the polycrystalline diamond layer is in front, and the substrate is in the back (as shown in FIG. 11). That is to say, the polycrystalline diamond layer is supported by the substrate at the back of the polycrystalline diamond layer. If the PDC cutter moves in the reverse direction during the working process, the substrate is in front and the polycrystalline diamond layer is behind, the polycrystalline diamond layer is directly subjected to reverse force, it is easy to cause the polycrystalline diamond layer to crack or fall off, which seriously reduces the working life of the PDC cutters, and even causes the damage and failure of the PDC cutters in a very short time.

Compared with existing technologies, embodiments in the present disclosure enjoy the following advantages:

(1) The rotating cutter on the cone of the present disclosure can rotate relative to the cone. The geometric center of the front cutting face of the rotating cutter or the front cutting face of the rotating cutter is offset from the rotating axis of the rotating cutter, and the geometric center of the rear cutting face or the rear cutting face of the rotating cutter is on the same side of the offset of the front cutting face. When the rotating cutter on the cone contact with rock and break rock, no matter the starting state of the contact between the cutter and rock, as long as the cutters are affected by rock reaction, the rotating cutter will rotate to the front cutting face in front, and the back of the front cutting face in back to scrape rock. The cutting element on the rotating cutter is offset from the rotating axis of the rotating cutter. Under the action of external force, the component force along the plane perpendicular to the rotating axis will drive the rotating cutter to rotate about its rotating axis, so that the normal of the front cutting face will cut rock along the direction of scraping. The normal direction of the front cutting face of the cutter always points to the scraping direction. The rotating cutters have the function of self-adjusting and self-adapting azimuth, so that the cutting elements on the rotating cutter are always in front of the front cutting face, while the back of the front cutting face is in the back direction to scrape the rock. In this way, diamond cutters with strong wear resistance can be used in this present disclosure, and in particular, it is possible to use PDC cutters which are very suitable for rock cutting by scraping. The structure scheme adopted in this disclosure provides conditions for the application of diamond cutters, especially PDC cutters, to single cone bits.

(2) The rotating cutters on the cone can rotate relative to the cone and the cutting elements of the rotating cutters are offset. The rotating cutters always scrape the rock with a stable scraping surface. No matter how the bit cone rotates, no matter the position of the rotating cutters on the cone, no matter how the direction of the scraping movement of the cutters on the cone changes, the rotating cutters on the cone will always scrape the rock with the front cutting face in front and the back of the front cutting face in back. The scraping direction of the rotating cutters relative to the rock will always remain unchanged, which is conducive to slowing down the wear of the cutters. The scraping friction direction of the cutters on the cone of the present disclosure is invariable relative to the rock. The scraping direction of the cutters on the common single cone is constantly changing with respect to the rock while working. Even if the cutters (such as cemented carbide teeth) in accordance with the existing technology are adopted, the wear and wear passivation speed of the cutters of the present disclosure is better than that of the common single cone bit.

(3) The cutting elements on the rotating cutters of the present disclosure can use PDC cutters that are highly wear resistant and are well suited for rock breaking in a scraping manner. The PDC cutters have good self-sharpness when scraping, and the wear rate of the polycrystalline diamond layer is significantly slower than that of the substrate. The scraping direction of the cutters on the cone of the common single cone bit is constantly changing with respect to the rock at the bottom of the well. During the process of rock scraping, the scraping direction of the cutters on the constant contact area of the cone changes from 0 to 360 degrees, the scraping direction of the cutters on the alternating contact area of the cone changes from 0 to 180 degrees. In the process of cemented carbide cutters changing in the direction of scraping, the top edge angle of the cutters will be grinded and passivated, and the scraping efficiency will be reduced. The PDC cutter is used on the rotating cutter. No matter how the cutter rotates, no matter the orientation of the cutter, when the PDC cutter on the rotating cutter scrapes the rock, the polycrystalline diamond layer is always in front and the substrate is behind. The scraping direction of the PDC cutter relative to the rock remains unchanged. The PDC cutter always scrapes the rock in the normal direction, which is beneficial to the full advantage of the PDC cutter scraping and cutting rock, and can fully utilize the wear resistance of the PDC cutter and self-sharpening features. Compared with cemented carbide cutters, PDC cutters are easier to penetrate rocks and scrape rocks. Therefore, the use of rotating cutters on the cone of the single cone bit can significantly improve the service life of the bit, at the same time, improve the scraping efficiency of the cutter and the rock breaking efficiency of the bit.

(4) The single cone bit has only one cone, which is easy for small wells. It should be a good drilling tool for deep wells and ultra-deep wells. However, due to the poor wear resistance of the existing cutters of the single cone bit and the low efficiency of rock scraping, the application effect of single cone bit is limited. As a result, single cone bit has been used less and less in drilling engineering. The rotating cutter structure proposed by the invention makes the PDC cutter which is very suitable for rock breaking in the form of scraping can be applied to the single cone bit, which improves the rock breaking efficiency and service life of the bit. This will broaden the use and enhance the application value of the single cone bit in drilling, especially in deep wells and slim wells.

As a choice, the front cutting face of rotating cutter faces its rotating axis. As a further choice, the normal line passing through the geometric center of the front cutting face of the rotating cutter intersects the rotating axis of the rotating cutter.

As a choice, the rotating cutter comprises a rotating shaft rotatably coupled to the cone, and a cutting element fixed on the rotating shaft. The cutting elements are selected from polycrystalline diamond compact, polycrystalline diamond composite cutter, thermostable polycrystalline diamond composite cutters, impregnated diamond cutters (blocks), cubic boron carbide, ceramic cutters, or polycrystalline diamond and impregnated diamond phase composite, or the combination of the above. When the cutting elements are polycrystalline diamond compacts, polycrystalline diamond composite cutters, or polycrystalline diamond and impregnated diamond composite cutters, the front end face of the polycrystalline diamond layer of the cutters is the front cutting face. In this scheme, because the structure of the rotating cutter is adopted, the cutting elements on the rotating cutters can scrape the rock in a stable direction. Therefore, the above-mentioned cutting elements having better wear resistance can be used on the rotating cutters of the present disclosure to improve the service life and rock breaking efficiency of the cutters and the entire drill bit.

As a choice, the geometric center of the front cutting face or the front cutting face of the rotating cutter is offset from the rotating axis of the rotating cutter by more than one eighth of the radius of the rotating shaft of the rotating cutter, less than twice the radius of the rotating shaft. In this scheme, in order to make the rotating cutter rotate smoothly to the correct scraping direction and keep good scraping orientation, the offset of the geometric center of the front cutting face or the front cutting face of the rotating cutters from the rotating axis of the rotating cutter should not be too small. The bigger the offset, the easier it is to rotate the rotating cutters smoothly, the more sufficient the driving force is to drive the rotating cutters to the normal direction, and the easier it is to ensure that the rotating cutters can keep good scraping position during the continuous rotation of the cone. However, the offset should not be too large. Too large offset will make the rotating cutters occupy a larger rotating space, resulting in a waste of space for cutter distribution. As a further choice, the offset is between 1 and 32 mm.

As a choice, the number of cutting elements on the rotating cutter is 1-6. In this scheme, the number of cutting elements on the rotating cutter may be one or more, and the number of cutting elements on the rotating cutter can be set according to the size of the drill bit, the size of the rotating cutter and the actual size of the cutting elements. As a further choice, the number of cutting elements on the rotating cutter is one, two or three.

As a choice, the rotating cutters are arranged on the constant contact area of the cone. In this scheme, the cutters in the constant contact area of the cone always contact with the bottom of the well to break the rock, and the wear rate of the cutters in the constant contact area of the cone is faster than that in other areas. The use of rotating cutters on the constant contact area of the cone can significantly improve the wear resistance and scraping efficiency of the cutters in this area, thereby improving the service life and rock breaking efficiency of the drill bit.

As a choice, the rotating cutters are arranged on the alternating contact area of the cone. In this scheme, the arrangement of the rotating cutters on the alternating contact areas of the cone can significantly improve the wear resistance and the cutting efficiency of the cutters in the area.

As a choice, a locking structure that restricts the movement of the rotating cutters in the direction of the rotating axis is provided between the rotating shaft of the rotating cutter and the cone. In this scheme, in order to prevent the rotating cutters from moving or falling off along the axis, a locking structure can be set between the rotating cutter and the cone to enhance the reliability and safety of the rotating cutters. The locking means that the rotating cutter is restrained in the direction of the rotating axis, preventing the rotating cutter from moving or falling off in the direction of the rotating axis, and does not limit the rotation of the rotating cutter relative to the cone. As a further choice, ball locking is used between the rotating shaft of the rotating cutter and the cone. Ball locking can minimize the influence of rotating motion of rotating cutters, and can achieve the restriction and axial locking of rotating cutter along their rotating axis direction, and is easy to process.

As a choice, a sealing structure is disposed between the rotating shaft of the rotating cutter and the cone. In this scheme, the bit works in drilling fluid and cuttings. The rotating cutter can rotate relative to the cone. In order to prevent other substances from entering the rotary pair between the rotary teeth and the cone, a sealing structure can be set between the rotating cutter and the cone to reduce the wear of the rotary pair and prolong the service life of the rotary pair.

As a choice, a bushing is provided between the rotating shaft of the rotating cutter and the cone. In this scheme, when the bit is working, because of the relative rotation between the rotating cutter and the cone, the force of the cutters is complex. A bushing is set between the rotating cutter and the cone. The bushing can be made of different materials, such as copper bushing to reduce wear, or cemented carbide bushing to increase wear resistance. As a further choice, the bushing and the cone are relatively tightened. The bushing and the cone can be tightened by interference fit, welding, etc. The bushing and the rotating shaft of the rotating cutter are rotationally coupled.

The main scheme of the invention and its further selection schemes can be freely combined to form a plurality of schemes, which are all schemes that the invention can adopt and require protection. Moreover, the invention can freely combine among (non-conflicting choices) choices and other choices. After understanding the scheme of the invention, technicians in the field can see that there are many combinations according to the existing technology and common sense, which are all the technical schemes to be protected by the invention, and there is no exhaustion here.

Figure 1:
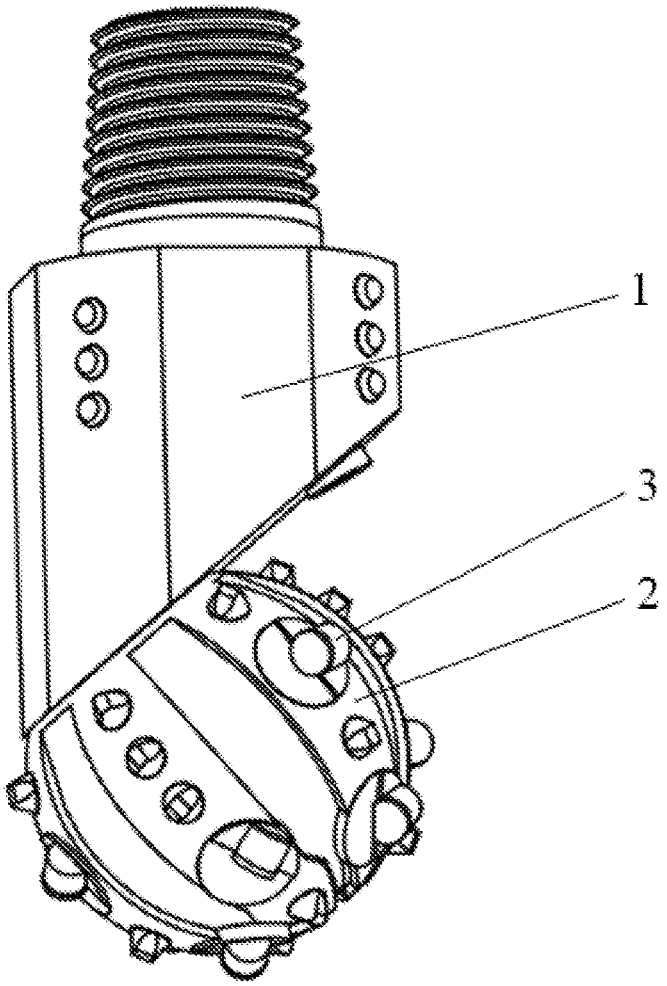
FIGS. 1 and 2 are schematic illustrations of embodiment 1 of the present disclosure.

In the figures, the numeral 1 is the bit body; the numeral 2 is the cone; the numeral 21 is the constant contact area; the numeral 22 is the alternating contact area; the numeral 3 is the rotating cutters; the numeral 31 is the PDC cutter substrate; the numeral 32 is the polycrystalline diamond layer of PDC cutter; the numeral 33 is the front cutting face of rotating cutters; the numeral 34 is the rotating axis of rotating cutters; the numeral 35 is the rear cutting face of rotating cutters; the numeral 36 is rotating shaft of rotating cutters; the numeral 37 is the back of front cutting face of rotating cutters; the numeral 4 is the rock; the numeral 5 is the sealing structure; the numeral 6 is the locking structure; the numeral 7 is the bushing.

Embodiments

The following non-limiting embodiments are used to illustrate the present disclosure.

Embodiment 1

Figure 2:
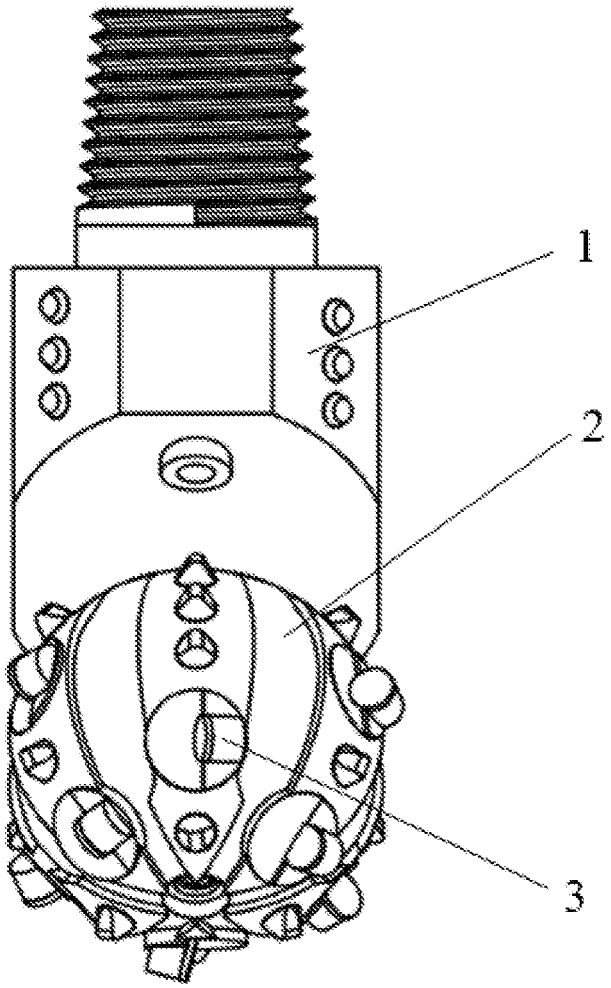
Figure 3:
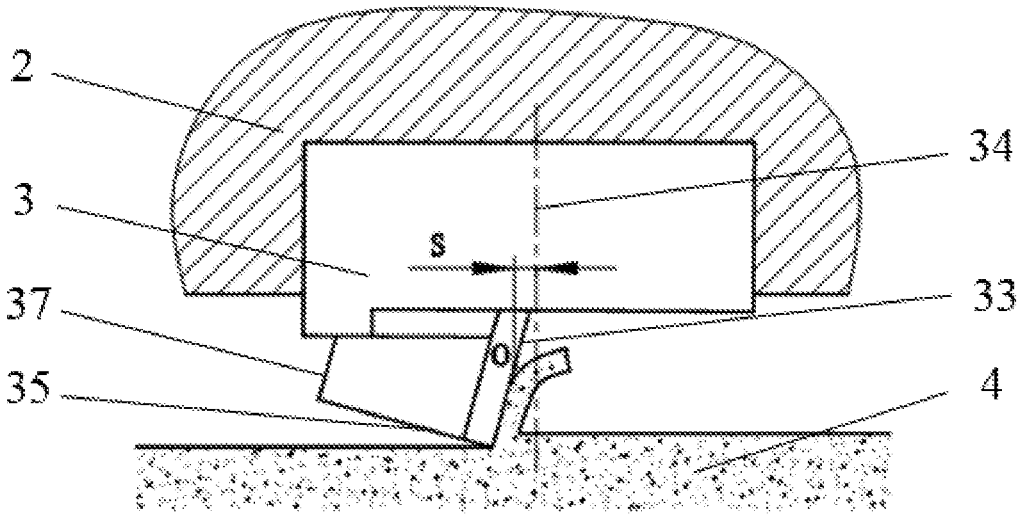
FIG. 3 is a schematic illustration of a rotating cutter scraping rock in embodiment 1 of the present disclosure.
Figure 4:
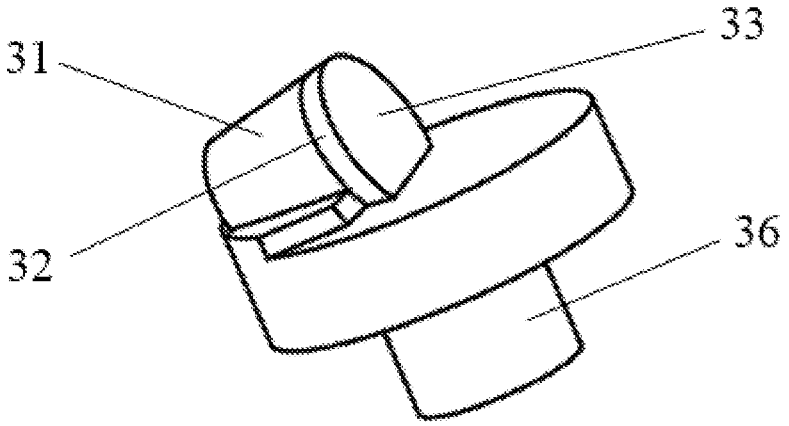
FIG. 4 is a schematic illustration of a rotating shaft of a rotating cutter in embodiment 1 of the present disclosure in the form of a journal with a step.
Figure 5:
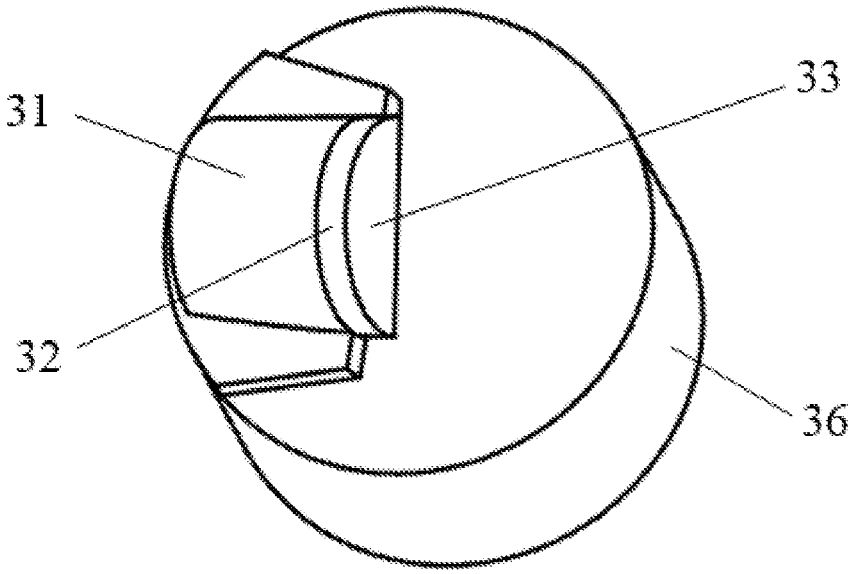
FIG. 5 is a schematic illustration of a cylindrical rotating shaft of a rotating cutter according to embodiment 1 of the present disclosure.
Figure 6:
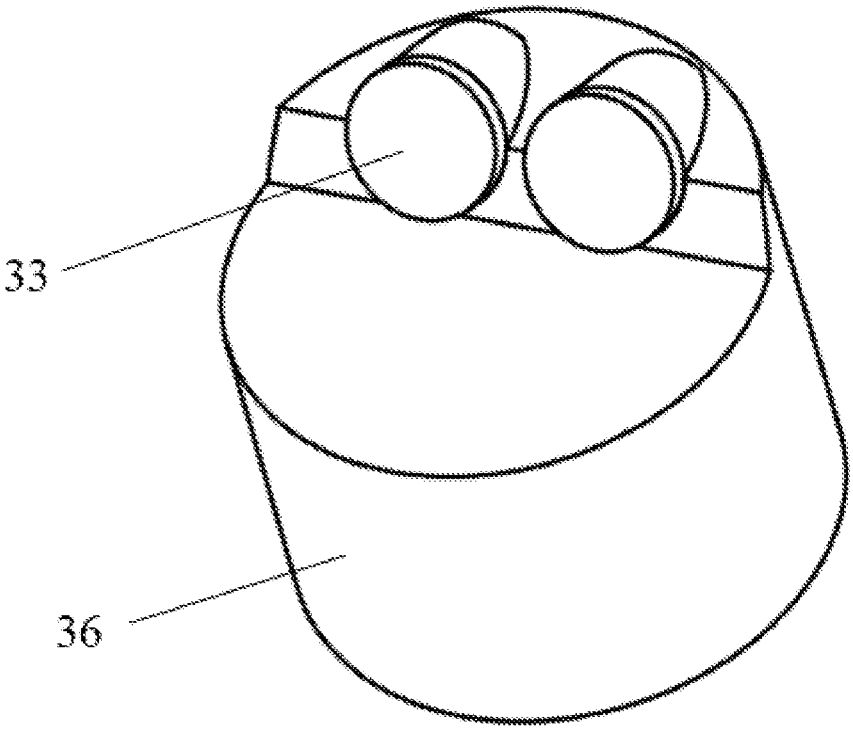
FIGS. 6 and 7 are schematic illustrations of two cutting elements on the rotating cutter of embodiment 1 of the present disclosure.
Figure 7:
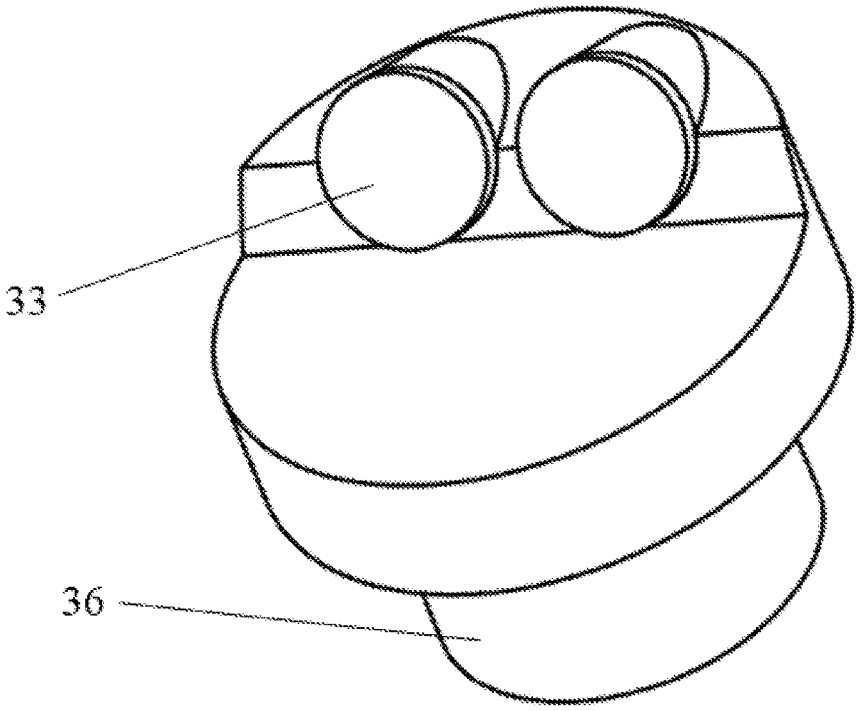

As illustrated in FIGS. 1-3: a rotating cutter single cone bit, which comprises a bit body 1 and a cone 2 that is rotatably coupled to the bit body 2, cutters are arranged on the cone 2, and at least one cutter on the cone 2 is a rotating cutter 3, the rotating cutter 3 forms a rotational connection with the cone 2. As a choice, as shown in the present embodiment, the rotating cutter 3 includes a rotating shaft 36 rotatably coupled to the cone 2, and a cutting element fixed on the rotating shaft 36. There is a shaft hole on the cone 2 corresponding to the rotating shaft 36 which contains the matching rotating cutter 3. The rotating shaft 36 is inserted into the shaft hole and can rotates on the cone 2. The rotating shaft 36 can take many forms. For example, FIGS. 4 and 7 show that the rotating shaft 36 of the rotating cutter 3 is a step journal, and FIGS. 5 and 6 show that the rotating shaft 36 of the rotating cutter 3 is a cylindrical shape. The cutting element is fixed on the top surface of the rotating shaft 36, and the front face (front end face of wear-resistant layer) of the cutting element forms an angle with the top surface of the rotating shaft 36. Consolidation between cutting elements and rotating shaft 36 can also take many forms. For example, as shown in FIGS. 4 and 5, part of the substrate and the side of the wear-resistant layer are trapped and fixed in the top surface; or as shown in FIGS. 6 and 7, a convex platform is formed in the top surface, and the side of the surface part is trapped and fixed in the convex platform, while the wear-resistant layer is exposed outside the convex platform. The geometric center of the front cutting face 33 of the rotating cutter 3 or the front cutting face 33 of the rotating cutter 3 is offset from the rotating axis 34 of the rotating cutter 3, and the geometric center of the rear cutting face 35 or the rear cutting face 35 of the rotating cutter 3 is on the same side of the offset of the front cutting face 33. The front cutting face 33 is closer to the rotating axis 34 of the rotating cutter 3 than the rear cutting face 35. The rotating cutter 3 is rotatable about the rotating axis 34 of the rotating cutter on the cone 2.

Figure 8:
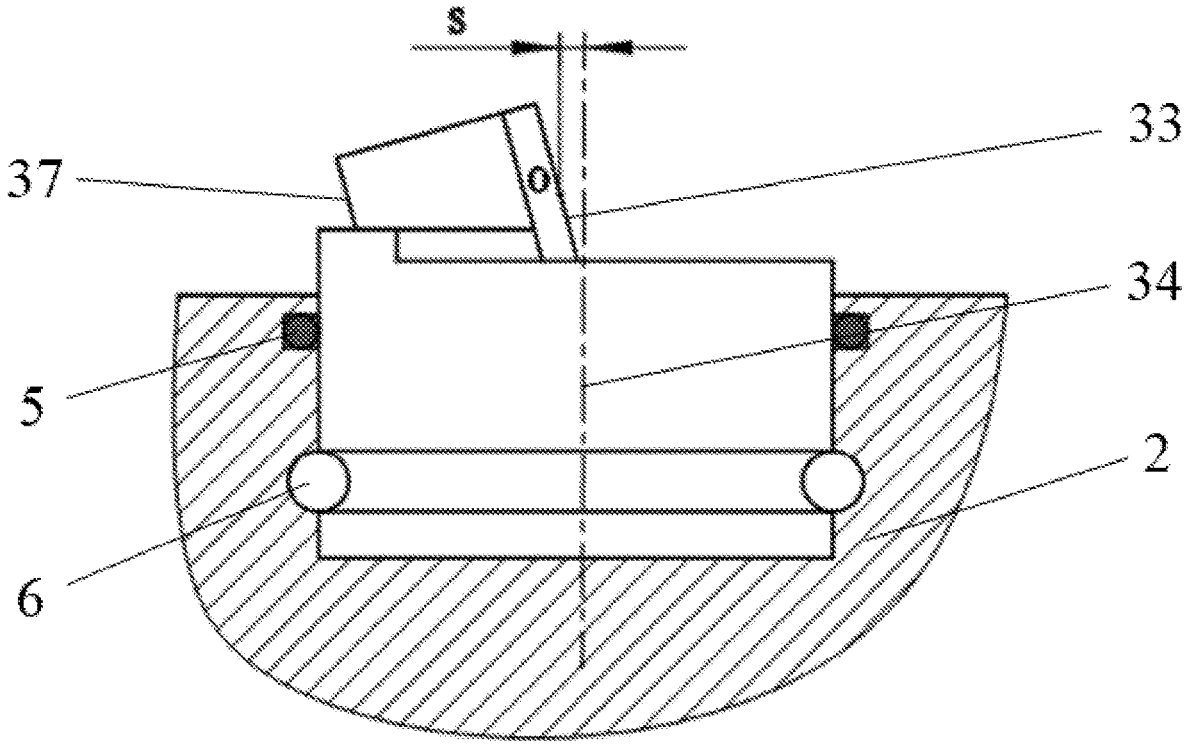
FIG. 8 is a schematic illustration of a locking structure and a sealing structure arranged between the rotating cutters and the cone in embodiments 4 and 5 of the present disclosure.
Figure 10:
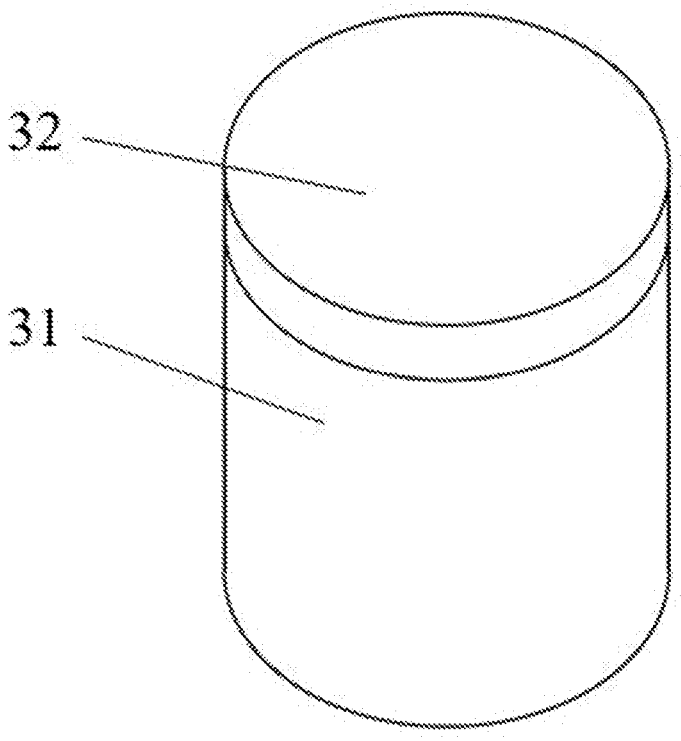
FIG. 10 is a schematic illustration of conventional PDC cutter structure.
Figure 11:
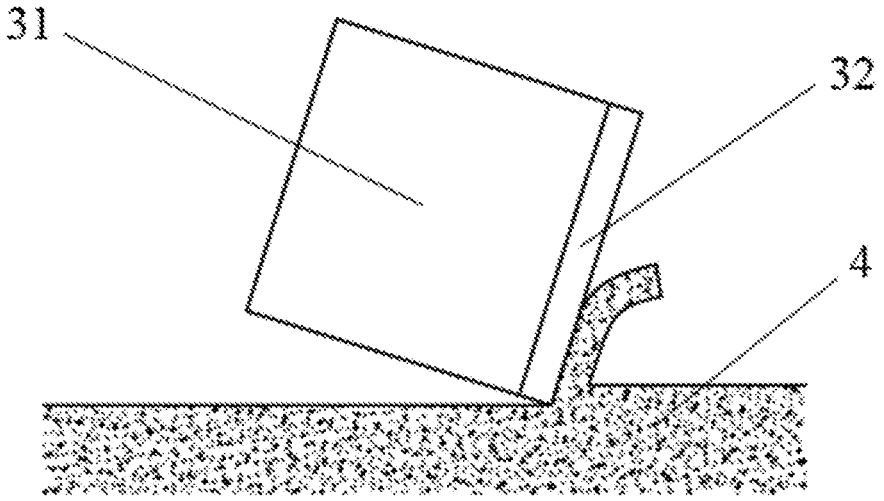
FIG. 11 is a schematic illustration of normal scraping of rock by conventional PDC cutters.
Figure 12:
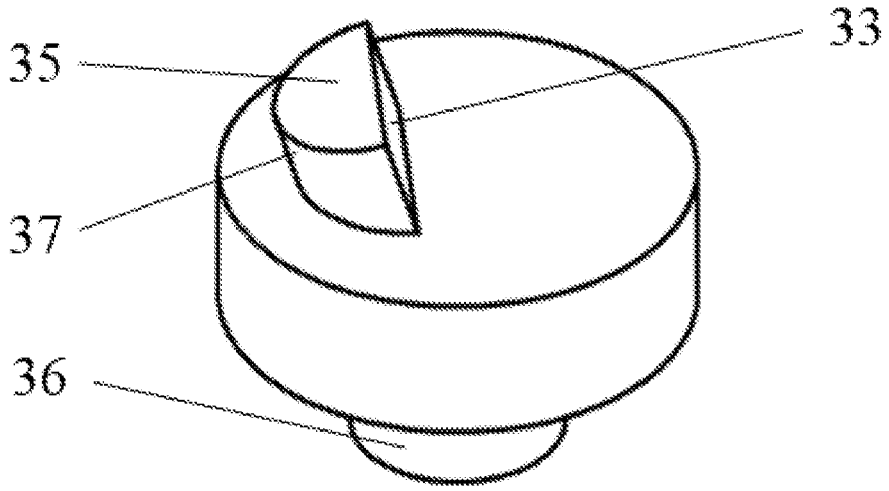
FIGS. 12, 13 and 14 are schematic illustrations of the cutting elements on the rotating cutters of embodiment 1 of the present disclosure, which are semi-cylindrical, wedge-shaped and vertically arranged respectively.
Figure 13:
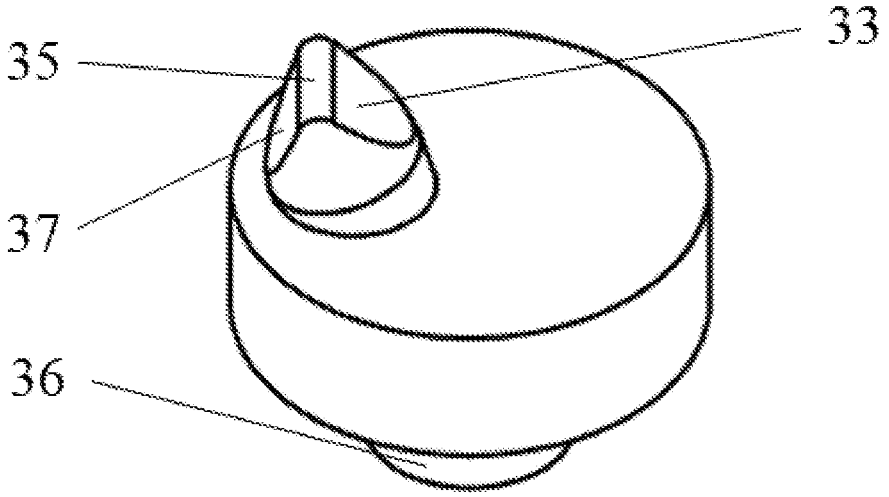
Figure 14:
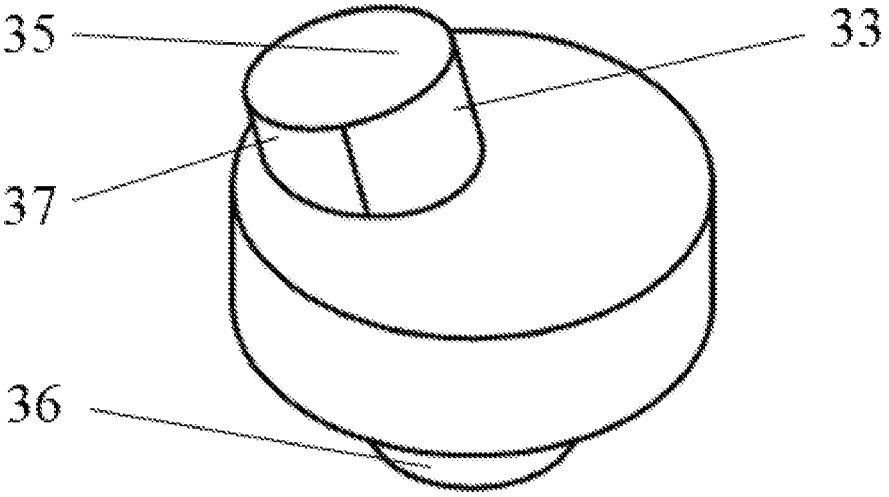

As a choice, the cutting elements on the rotating cutter 3 may be polycrystalline diamond compact, polycrystalline diamond composite cutters, thermostable polycrystalline diamond composite cutters, impregnated diamond cutters (blocks), cubic boron carbide, ceramic cutters, or polycrystalline diamond and impregnated diamond phase composite. As a further choice, the cutting elements on the rotating cutter 3 are polycrystalline diamond compact. Polycrystalline diamond compact consists of a polycrystalline diamond layer 32 and a substrate 31 (as shown in FIG. 10). The front end surface of the polycrystalline diamond layer 32 is the front cutting face 33 of the cutting element, and the side surface is the rear cutting face 35 (as shown in FIG. 3). As a choice, the shape of the cutting element on the rotating cutter 3 is semi-cylindrical (as shown in FIG. 12), wedge-shaped (as shown in FIG. 13) or vertically arranged cylindrical (as shown in FIG. 14), etc. As a choice, the offset S of the geometric center O of the front cutting face 33 of the rotating cutter 3 or the front cutting face 33 of the rotating cutter 3 to the rotating axis 34 of the rotating cutter 3 is greater than one eighth of the radius of the rotating shaft 36, and less than twice the radius of the rotating shaft 36 (as shown in FIGS. 3 and 8). As a further choice, the offset S is between 1 and 32 mm. The number of cutting elements on the rotating cutter 3 may be one or more. As a choice, the number of cutting elements on the rotating cutter 3 is 1-6. As a further choice, the number of cutting elements on the rotating cutter 3 is one (as shown in FIGS. 1, 2), two (as shown in FIGS. 6, 7) or three. When the cutting element is one, it is preferable that the normal of the geometric center of the front cutting face of the rotating cutter intersects with its rotating axis. When the cutting elements are more than one, the front cutting faces 33 of each cutting elements are arranged side by side toward the rotating axis 34, and are distributed to the left and right with respect to the rotating axis 34.

Embodiment 2

Figure 9:
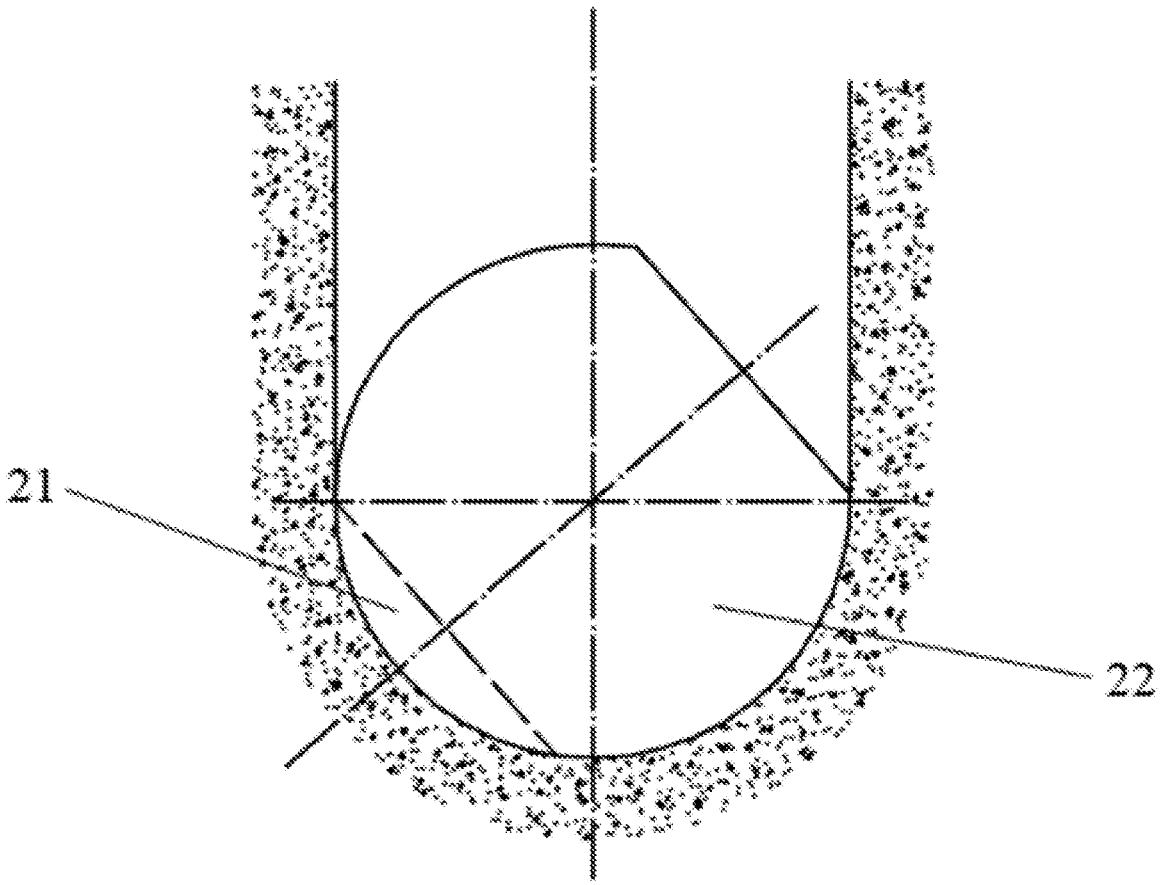
FIG. 9 is a schematic illustration of contact area division of the cone in contact with the rock at the bottom of the well.

Referring to FIGS. 1, 2, and 9, the present embodiment is substantially the same as Embodiment 1. The difference is that the rotating cutters 3 are arranged on the constant contact area 21 of the cone 2.

Embodiment 3

Referring to FIGS. 1, 2, and 9, the present embodiment is substantially the same as Embodiment 2. The difference is that the rotating cutters 3 are arranged on the alternating contact area 22 of the cone 2.

Embodiment 4

Referring to FIG. 8, the present embodiment is substantially the same as Embodiment 1. The difference is that a locking structure 6 for restricting the movement of the rotating cutter 3 relative to the cone 2 in the direction of the rotating axis 34 is provided between the rotating shaft of the rotating cutter 3 and the cone 2.

Embodiment 5

Referring to FIG. 8, the present embodiment is substantially the same as Embodiment 1. The difference is that a sealing structure 5 is disposed between the rotating cutter 3 and the cone 2.

Embodiment 6

Figure 15:
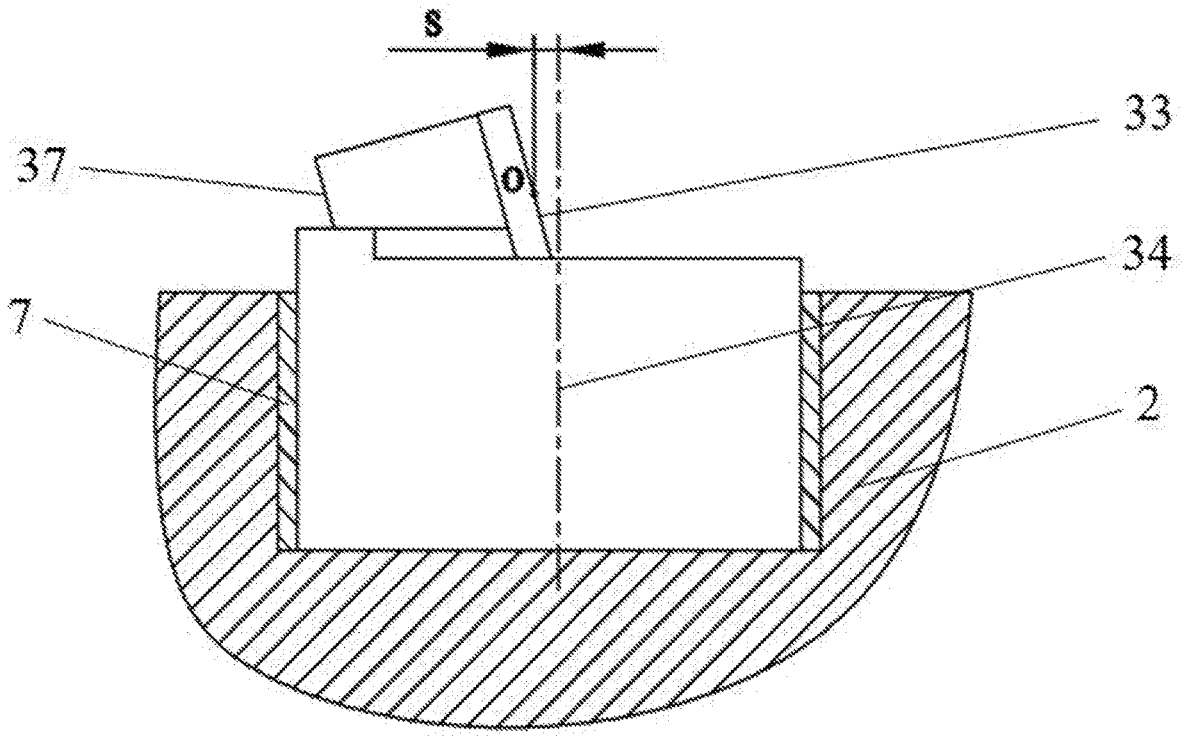
FIG. 15 is a schematic illustration of a bushing between a rotating cutter and a cone in embodiment 6 of the present disclosure.

Referring to FIG. 15, the present embodiment is substantially the same as Embodiment 1. The difference is that a bushing 7 is provided between the rotating cutter 3 and the cone 2. As a choice, the bushing 7 and the cone 2 are relatively tightened. The bushing 7 and the cone 2 can be tightened by interference fit, welding, etc. The bushing 7 and the rotating shaft of the rotating cutter 3 are rotationally coupled.

The disclosure has been shown or described in only some of its forms, it should be apparent to those skilled in the art that it is not so limited, but is susceptible to various changes without departing from the scope of the disclosure as hereinafter claimed, and legal equivalents thereof.

The invention claimed is:

1. A rotating cutter single cone bit, comprising: a bit body; a cone that is rotatably coupled to the bit body; and a plurality of cutters arranged on the cone, wherein at least one of the plurality of cutters on the cone is a rotating cutter having a rotational connection with the cone, wherein a rotational axis of the rotating cutter resides in an imaginary plane that divides the rotating cutter into a first side and a second side, wherein a geometric center of a front cutting face of the rotating cutter or the front cutting face of the rotating cutter resides in the first side, and a geometric center of a rear cutting face or the rear cutting face of the rotating cutter resides in the first side, and wherein a distance between the front cutting face and the rotational axis of the rotating cutter is less than a distance between the rear cutting face and the rotational axis of the rotating cutter.

2. The rotating cutter single cone bit of claim 1, wherein the rotating cutter comprises a rotating shaft rotatably coupled to the cone, and one or more cutting elements affixed to the rotating cutter, wherein the one or more cutting elements are selected from a polycrystalline diamond compact (PDC), a polycrystalline diamond composite cutter, a thermostable polycrystalline diamond cutter, an impregnated diamond cutter, a cubic boron carbide cutter, a ceramic cutter, a polycrystalline diamond and impregnated diamond phase composite cutter, or a combination thereof, wherein, when the one or more cutting elements are the polycrystalline diamond compact, the polycrystalline diamond composite cutter, or the polycrystalline diamond and impregnated diamond composite cutter, the one or more cutting elements are oriented so that a front end face of the polycrystalline diamond layer of the one or more cutting elements is the front cutting face.

3. The rotating cutter single cone bit of claim 2, wherein the distance between the geometric center of the front cutting face or the front cutting face of the rotating cutter and the rotational axis of the rotating cutter is more than one eighth of a radius of the rotating shaft and less than twice the radius of the rotating shaft.

4. The rotating cutter single cone bit of claim 2, wherein a total number of the one or more cutting elements affixed to the rotating cutter ranges from 1 to 6.

5. The rotating cutter single cone bit of claim 2, further comprises a locking structure disposed between the rotating shaft of the rotating cutter and the cone and restricts a movement of the rotating cutter in the direction of the rotational axis.

6. The rotating cutter single cone bit of claim 5, wherein the locking structure is a ball locking.

7. The rotating cutter single cone bit of claim 2, further comprising a sealing structure disposed between the rotating shaft of the rotating cutter and the cone.

8. The rotating cutter single cone bit of claim 2, further comprising a bushing disposed between the rotating shaft of the rotating cutter and the cone.

9. The rotating cutter single cone bit of claim 8, wherein the bushing and the rotating shaft of the rotating cutter are rotationally coupled.

10. The rotating cutter single cone bit of claim 1, wherein a distance between the geometric center of the front cutting face of the rotating cutter is between 1 and 32 mm.

11. The rotating cutter single cone bit of claim 1, wherein the rotating cutter is arranged on a constant contact area of the cone or an alternating contact area of the cone.

12. The rotating cutter single cone bit of claim 1, wherein a line passing through the geometric center of the front cutting face of the rotating cutter intersects the rotational axis of the rotating cutter.

* * * * *